US005842676A

United States Patent [19]

Plzak

[11] Patent Number: 5,842,676

[45] Date of Patent: Dec. 1, 1998

[54] CUT-TREE STAND WITH OVER-CENTER CLAMPS

[76] Inventor: Steve James Plzak, 660 Williamson Rd., Bryn Mawr, Pa. 19010

[21] Appl. No.: 676,714

[22] Filed: Jul. 8, 1996

[51] Int. Cl.[6] ..... A44B 11/25

[52] U.S. Cl. ..... 248/523; 248/288.5; 248/519; 24/516; 24/504

[58] Field of Search ..... 248/516, 514, 248/519, 523, 288.5; 24/516, 494, 504

[56] References Cited

U.S. PATENT DOCUMENTS

| | | | |
|---|---|---|---|
| 2,219,991 | 10/1940 | Hawie | 24/516 |
| 2,287,722 | 6/1942 | Beazley | 24/170 |
| 2,382,658 | 8/1945 | Oliver | 24/516 X |
| 3,109,475 | 11/1963 | Whitman | 24/494 X |
| 3,193,842 | 7/1965 | Bell | 24/516 X |
| 3,346,929 | 10/1967 | Webb | 24/494 |
| 3,531,835 | 10/1970 | Paikin | 24/516 |
| 4,141,119 | 2/1979 | Nodo | 24/504 |
| 4,233,713 | 11/1980 | Berg | 24/170 X |
| 4,727,628 | 3/1988 | Rudholm | 24/191 X |
| 5,621,953 | 4/1997 | Fildan | 24/170 |

*Primary Examiner*—Peter M. Cuomo
*Assistant Examiner*—Stephen Vu
*Attorney, Agent, or Firm*—Derchert Price & Rhoads

[57] ABSTRACT

A stand for supporting a cut tree for display includes an inner bowl with an outer surface in the form of a segment of a sphere. The inner bowl includes a tree-trunk engaging device for holding the tree trunk in a roughly vertical position in the inner bowl. The inner bowl is supported in a rotatable and tiltable manner within an outer bowl-like support member. The inner bowl can be clamped to the outer bowl-like member by clamps spaced about the periphery of the inner bowl. Each clamp includes a bearing member hinged to the inner bowl, which bears against the exterior of the outer bowl-like member. Each bearing member is forced against the outer bowl-like member by an over-center clamp. The tree trunk is held against a vertical support by a strap-and-buckle arrangement including a cam which simultaneously pinches the strap at two different locations in the clamped position of the cam, for providing continuous adjustment of the strap length.

3 Claims, 10 Drawing Sheets

CUT-TREE STAND WITH OVER-CENTER CLAMPS

FIELD OF THE INVENTION

This invention relates to stands for cut display trees such as Christmas trees, and more particularly to such stands in which tilt and rotation are provided by nested inner and outer bowls, and in which over-center clamps are used to clamp the inner and outer bowls together for stability, and to clamp the trunk-engaging straps.

BACKGROUND OF THE INVENTION

U.S. patent application Ser. No. 08/423,289, filed Apr. 17, 1995 in the name of Plzak, describes an improved cut tree display stand or support, in which an inner upward-facing bowl with an outer portion in the shape of a portion of a sphere is nested within a corresponding outer bowl-like structure or support (outer bowl) having an inner surface in the surface of a portion of a sphere. There is sufficient clearance between the inner and outer bowls so that the inner bowl can be tilted and rotated relative to the outer bowl. The outer bowl-like support is adapted to sit on a flat floor, and the inner bowl includes a tree-trunk engaging portion which can be clamped to the trunk of a cut tree, so that the trunk of the cut tree extends approximately parallel with the axis of symmetry of the inner bowl. The inner bowl can be rotated within the outer bowl to face a particular portion of the tree in a given direction, and can also be tilted within the outer bowl in order to cause the tree to appear to stand upright, notwithstanding a curvature of a portion of the trunk. As described therein, the inner bowl is clamped to the outer bowl by a screw arrangement, and the tree trunk engaging portion includes straps which are coupled thereto by a stepwise adjustable fastener arrangement. When the two bowls are nested, and the inner bowl supports a tree, there may be sufficient contact area and force therebetween so that the bowls will not move relative to each other unless the tree is contacted, as might occur, for example, when ornaments are being hung, the tree watered, or presents are placed thereunder. Also, it may occasionally be desirable to lift or move the tree while it is in the stand, without changing the orientation of the tree. The bowl clamping arrangement prevents the bowls from changing orientation under such conditions. The screw arrangement for clamping the bowls together is not as convenient as might be desirable, as it requires many turns for the screw to be moved to the fully-decoupled position of the bowls to the fully-clamped condition, and it may be difficult to maintain the tree in the desired position long enough to tighten the screws. Further, it is difficult to determine by examining the screw when the bowls are sufficiently clear from each other to allow the upper bowl to be removed from the lower bowl, and this is exacerbated when multiple screws must be loosened, as some of the screws are likely to be on a side of the tree opposite to the person performing the loosening. The screw arrangement is also susceptible to stripping of the threads of either the screw or the clamp due to overtightening, or due to cross-threading when they are initially engaged. The stepwise fastener arrangement is less convenient than may be desired, as repeated attempts to tighten each strap around the tree trunk may be required, with each attempt including the need to adjust the effective strap length by means of the stepwise adjuster.

An improved cut-tree display stand is desired.

SUMMARY OF THE INVENTION

A stand for a decorative cut tree includes an upward-facing inner bowl which is approximately symmetric about an axis of symmetry. The inner bowl includes a tree trunk support arrangement adapted for supporting a tree trunk in a position with the tree trunk extending approximately parallel to the axis of the inner bowl. The stand also includes an upward-facing outer bowl-like member or structure (bowl), dimensioned for accommodating at least a portion of the inner bowl therein, in a manner which allows the inner bowl to tilt, rotate, or both tilt and rotate, relative to the outer bowl. The outer bowl includes a base arrangement adapted for allowing the outer bowl to rest stably on a flat floor. A clamping arrangement is affixed to an upper portion of the inner bowl for clamping the inner bowl to the outer bowl. The clamping arrangement includes (a) an elongated first member hingedly affixed at its upper end to the inner bowl by a first hinge defining a first hinge axis, and (b) a clamp member hingedly affixed to the inner bowl by a second hinge axis extending parallel to the first hinge axis. The elongated first member also including a bearing portion at its lower end, which is adapted for bearing against the outer surface of the outer bowl in one position of the elongated first member about the first hinge axis. The clamp member includes a handle portion and a bearing portion adapted for bearing against the elongated first member at a location between the upper and lower ends of the first member, for providing a force tending to force the bearing end of the elongated first member against the outer surface of the outer bowl, thereby urging the inner bowl into intimate contact with the outer bowl at the location of the bearing portion of the elongated first member. A stand according to a particular embodiment of the invention includes an over-center bearing portion of the clamp member which, in a closed condition of the clamping arrangement, tends to maintain the clamping arrangement in the closed condition. In an embodiment of the invention, at least one of the first and second hinges are formed, in part, by a clevis affixed to an upper portion of the inner bowl. The clevis including first and second forks, and defines apertures at the locations of at least one of the first and second hinge axes. A stand according to an embodiment of the invention has the hinge-defining portion of the clevis at the locations of the first hinge axis lying closer to the axis of revolution of the inner bowl than the hinge-defining portion of the clevis at the locations of the second hinge axis. Each stand according to the invention preferably includes a plurality of the clamping members spaced about the periphery of the inner bowl, and the plurality is preferably three.

A buckle according to another aspect of the invention imparts a tensile force between an elongated flexible strap and a buckle hinge or support arrangement. The buckle comprises a main buckle structure adapted to be coupled by the buckle hinge or support arrangement for transferring force from the main buckle structure in a direction normal to the axis of the buckle hinge or support arrangement. The main buckle structure is elongated along an "axis" of elongation as seen in a plane orthogonal to the axis of the buckle hinge or support arrangement, and defines first and second ends as seen in that plane. The buckle hinge or support arrangement is coupled to the first end of the main buckle structure for rotation about the axis of the buckle hinge or support arrangement. The main buckle structure further defines elongated first and second load bearing portions, each of which extends parallel with the axis of the buckle hinge or support arrangement at fixed locations on the main buckle structure, which fixed locations lie between the first and second ends of the main buckle structure. Both the elongated first and second load bearing portions lie in a second plane. The second plane is generally transverse to the "axis" of elongation of the main buckle structure. The main buckle structure further defines an elongated third load bearing portion extending parallel with the axis of the buckle hinge or support arrangement, and lying in a third plane which is generally transverse to the "axis" of elongation. The third plane is at a location lying between the second plane and the second end of the main buckle structure. The main buckle structure further includes a second hinge coupler defining a second hinge axis parallel with the axis of the buckle hinge or support arrangement. The second hinge axis lies between the second plane and the third plane. A cam arrangement defines a first load bearing portion near a first end thereof and a second load bearing portion near a second end thereof. The cam arrangement includes a second hinge coupler lying between the first and second ends of the cam arrangement. The second hinge coupler is adapted for hinged coupling of the cam means to the second hinge coupler of the main buckle structure, for rotation of the cam arrangement relative to the main buckle structure between a closed position and an open position. The closed position is one in which the first load bearing portion of the cam arrangement is juxtaposed with the first load bearing portion of the main buckle structure and the second load bearing portion of the cam arrangement is juxtaposed with the third load bearing portion of the main buckle structure, and the open position of the cam arrangement relative to the main buckle structure is one in which the cam arrangement is rotated so that the first bearing portion of the cam arrangement is separated from the first bearing portion of the main buckle structure by an amount greater than in the closed position, and in which the second bearing portion of the cam arrangement is separated from the third bearing portion of the main buckle structure by an amount greater than in the closed position. As a result of this dimensioning, a strap extending, in order, past the buckle hinge or support arrangement, partially around the second load bearing portion of the main buckle structure, between the first bearing portion of the cam means and the first bearing portion of the main buckle structure, and between the second bearing portion of the cam arrangement and the third bearing portion of the main buckle structure, is simultaneously pinched between (a) the first bearing portion of the cam means and the first bearing portion of the main buckle structure, and (b) the second bearing portion of the cam arrangement and the third bearing portion of the main buckle structure, in the closed position of the cam arrangement, in a manner such that tensile forces applied to the strap relative to the buckle tend to increase the pinch, thereby tending to grip the strap more firmly with increasing tensile forces. Also, in the open position of the cam arrangement, the strap is substantially free to slip, without being pinched, past (a) the first bearing portion of the cam means and the first bearing portion of the main buckle structure, and (b) the second bearing portion of the cam arrangement and the third bearing portion of the main buckle structure.

DESCRIPTION OF THE INVENTION

Figure 1:
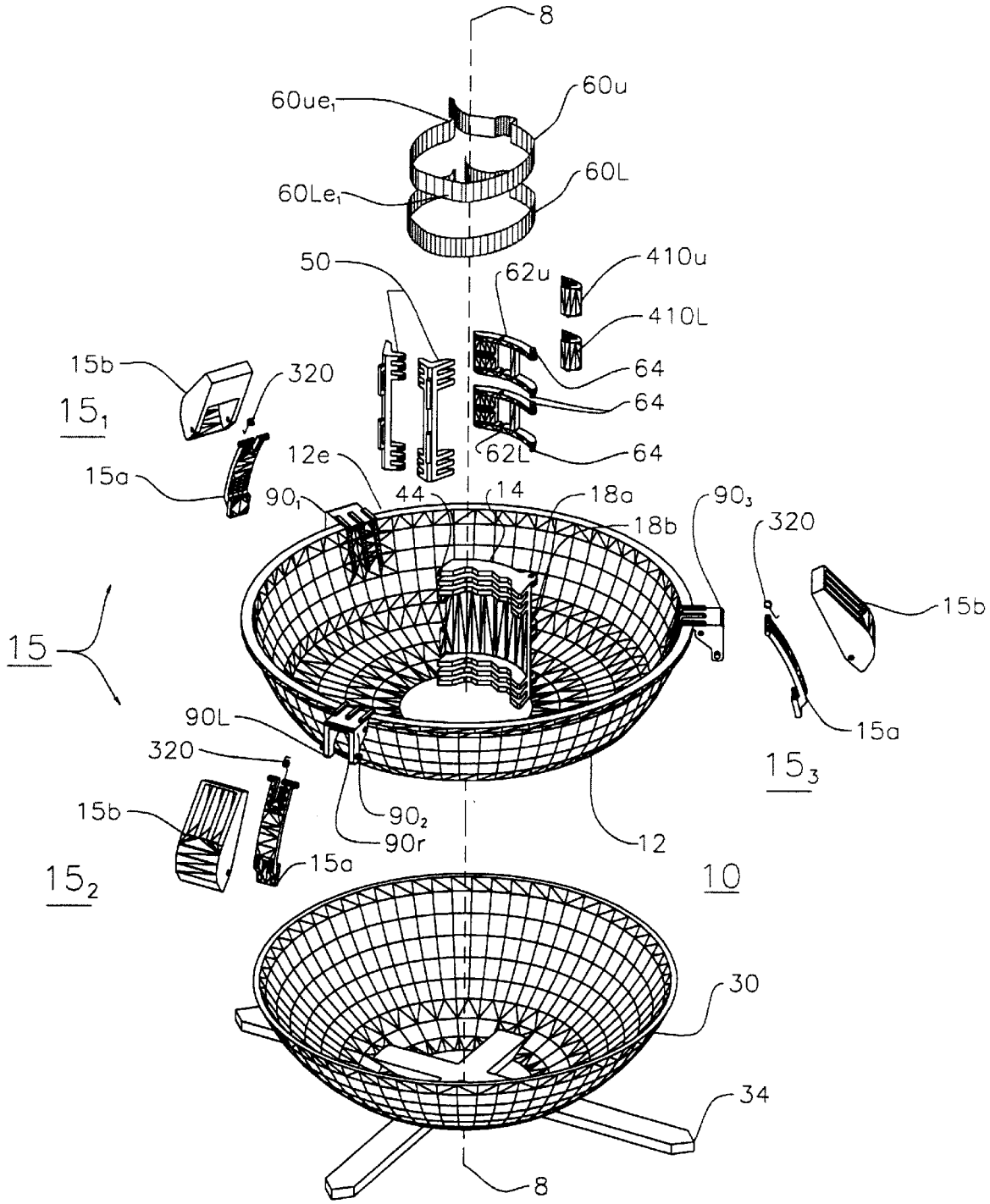
FIG. 1 is a perspective or isometric view of a cut-tree stand according to the invention, exploded to illustrate details of the invention and the relationships among elements of the stand.
Figure 2:
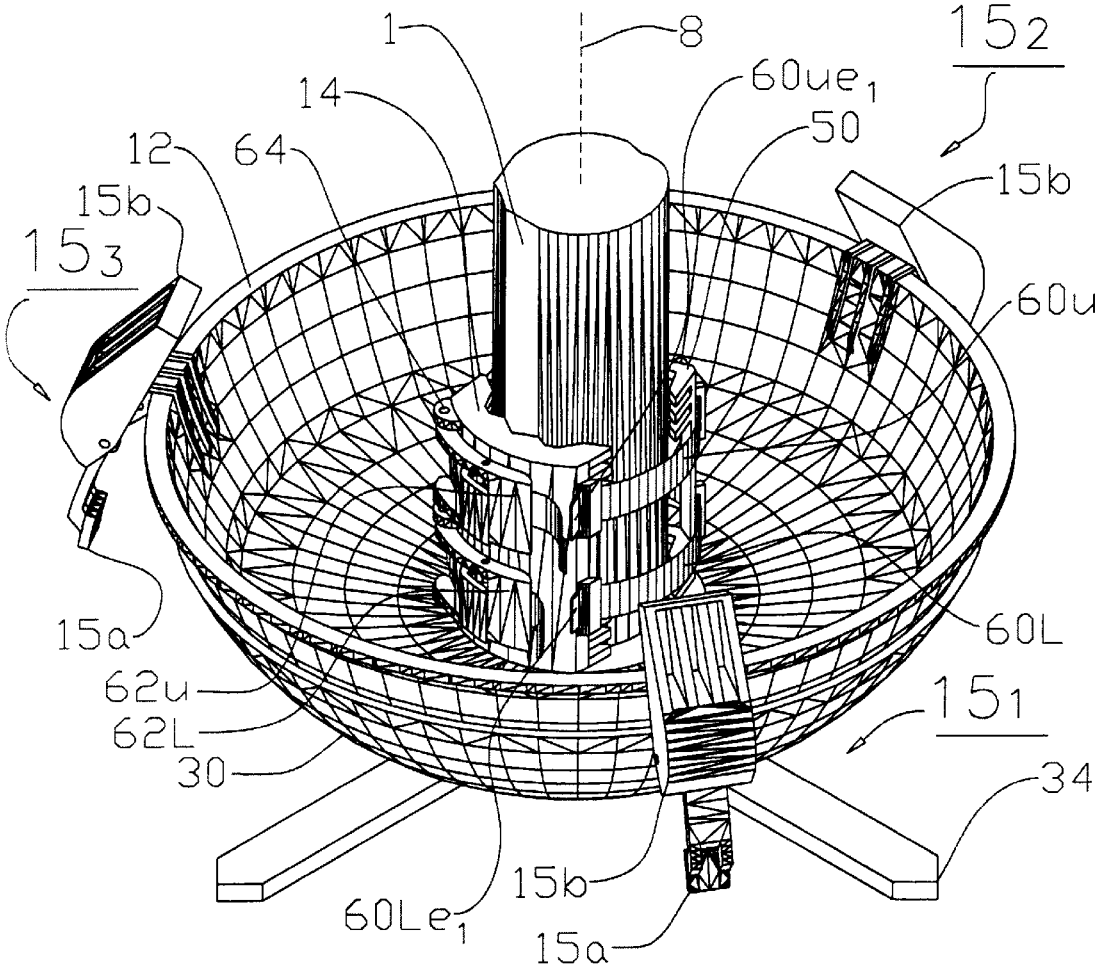
FIG. 2 is a perspective or isometric view of the cut-tree stand of FIG. 1 in its assembled condition, including a tree trunk.

In FIGS. 1 and 2, a cut-tree stand 10 includes an inner support bowl 12, which may have a closed bottom for holding water or nutrient fluid. Inner bowl 12 is symmetrical about an axis of revolution 8, which is approximately vertical when stand 10 is in use for supporting a cut tree. As described in the abovementioned Plzak patent application, a vertically-extending tree-trunk engaging vertical support portion 14 is affixed to or monolithically integral with the inner bowl 12, and includes a roughened or serrated face 44 where support 14 actually engages the tree trunk 1. As illustrated in FIG. 1, tree-trunk engaging portion vertical support portion 14 also supports an upper set of hinge portions 18*a* and 18*b*, and a similar lower set of hinge portions is also illustrated. These hinge portions coact with mating hinge portions 64 of upper strap buckle 62*u* and lower strap buckle 62l, allowing the strap buckles to rotate about hinge axes 64*a* (FIGS. 4*a*, 4*b*, 4*c*, 4*d*).

In FIGS. 1 and 2, inner bowl 12 nests in an outer bowl-like member 30. Member 30 is not necessarily a bowl, in the sense that it may not have a closed bottom capable of holding a liquid. The inner surface of bowl-like member 30 (bowl) takes on the curvature of a portion of a sphere, to conform to the outer surface of inner bowl 12. When the inner and outer bowls are nested, the inner bowl can rotate and tilt within outer bowl 30. Outer bowl 30 is associated with a base arrangement 34 which allows it to sit on a flat floor in a stable manner. A set of standoffs designated 50 bear against the tree trunk 1, and support upper and lower tree-engaging straps 60*u* and 601 away from trunk 1. An end $\mathbf{60}ue_1$ of strap 60*u* is coupled to vertical support portion 14 at a location near the top of support portion 14, and a corresponding end $\mathbf{601}e_1$ of strap 601 is also coupled to vertical support portion 14 at a location below that of upper strap 60*u*.

The inner (12) and outer (30) bowls of stand 10 of FIGS. 1 and 2 are dimensioned so that they may move relative to each other in a universal manner, that is in a manner which may be described as tilt and rotation. When a tree is supported by the stand 10, however, the forces between the bowls tends to prevent relative movement due to incidental forces. However, it may be desirable to clamp the inner and outer bowls together to prevent movement under conditions in which the tree may be bumped, as during decoration or watering. For this purpose, a set of clamps designated generally as 15 is associated with the stand. Set 15 of clamps includes three identical clamps $\mathbf{15}_1$, $\mathbf{15}_2$, and $\mathbf{15}_3$ spaced about axis 8, and affixed to clamp supports $\mathbf{90}_1$, $\mathbf{90}_2$, and $\mathbf{90}_3$, respectively, near the upper edge or rim 12*e* of inner bowl 12. Affixing the clamps $\mathbf{15}_1$, $\mathbf{15}_2$, and $\mathbf{15}_3$ of set 15 at a location lower than edge 12*e* would tend to interfere with the amount of tilt available before the clamps interfered with the lower bowl, and thus the edge fastening is preferred. Each clamp support $\mathbf{90}_1$, $\mathbf{90}_2$, and $\mathbf{90}_3$ is in the form of a clevis including first and second forks (90*l* and 90*r* of clamp support $\mathbf{90}_2$ of FIG. 1).

Figure 3A:
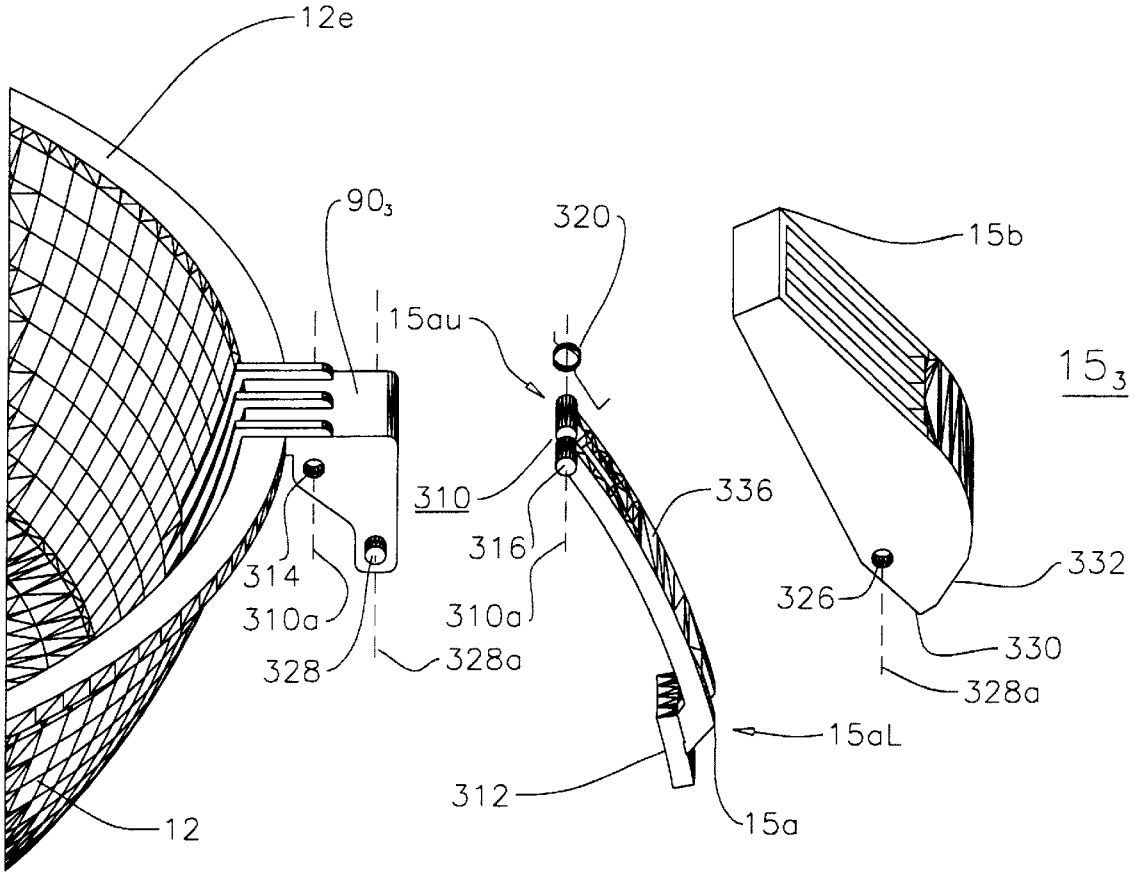
FIG. 3*a* is an enlarged view of the exploded bowl clamp of the stand of FIG. 1.
Figure 3B:
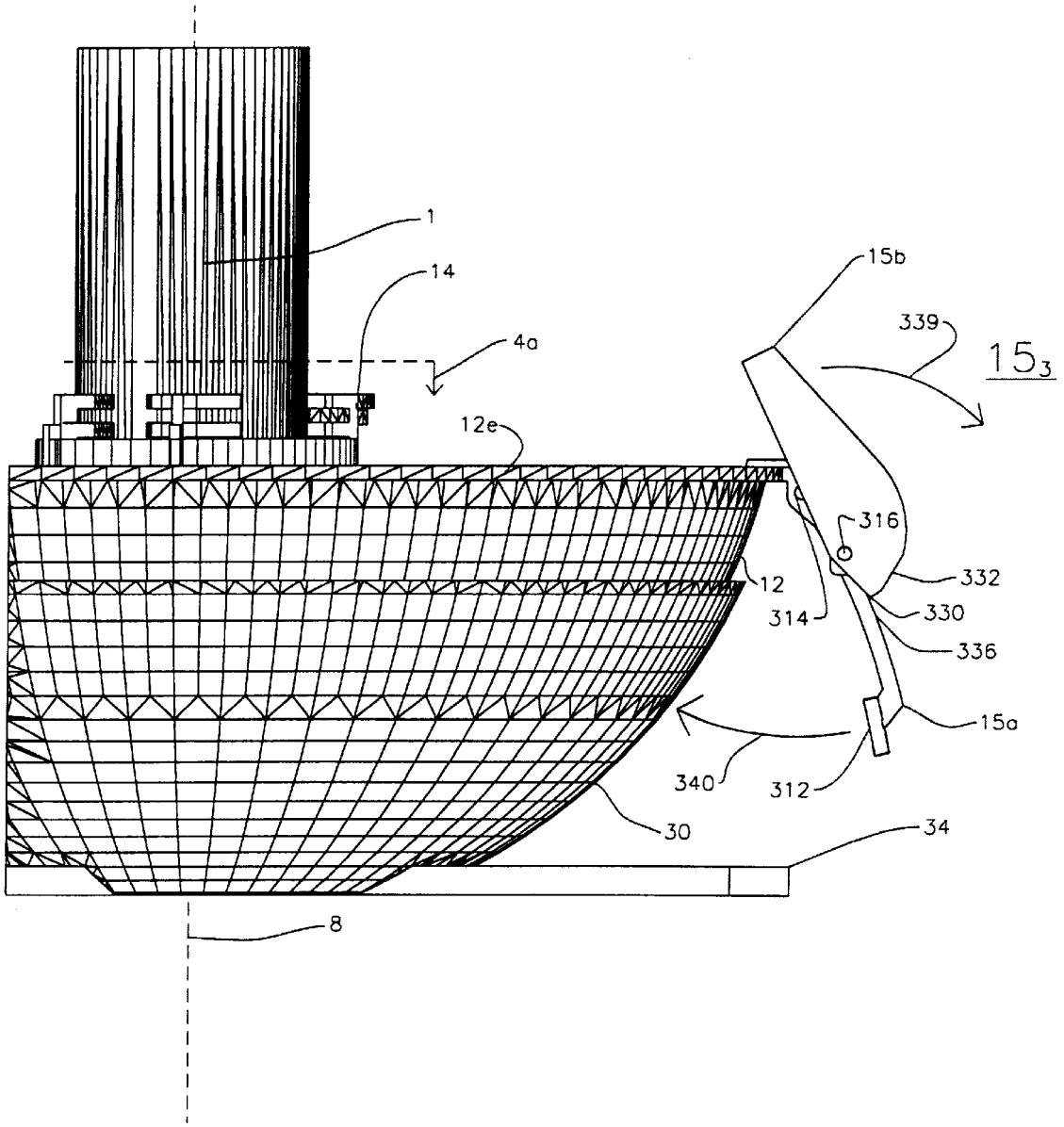
FIG. 3*b* is a side elevation of the assembled arrangement of FIG. 2 illustrating the bowl clamp of FIG. 3*a* in a first or loose position.
Figure 3C:
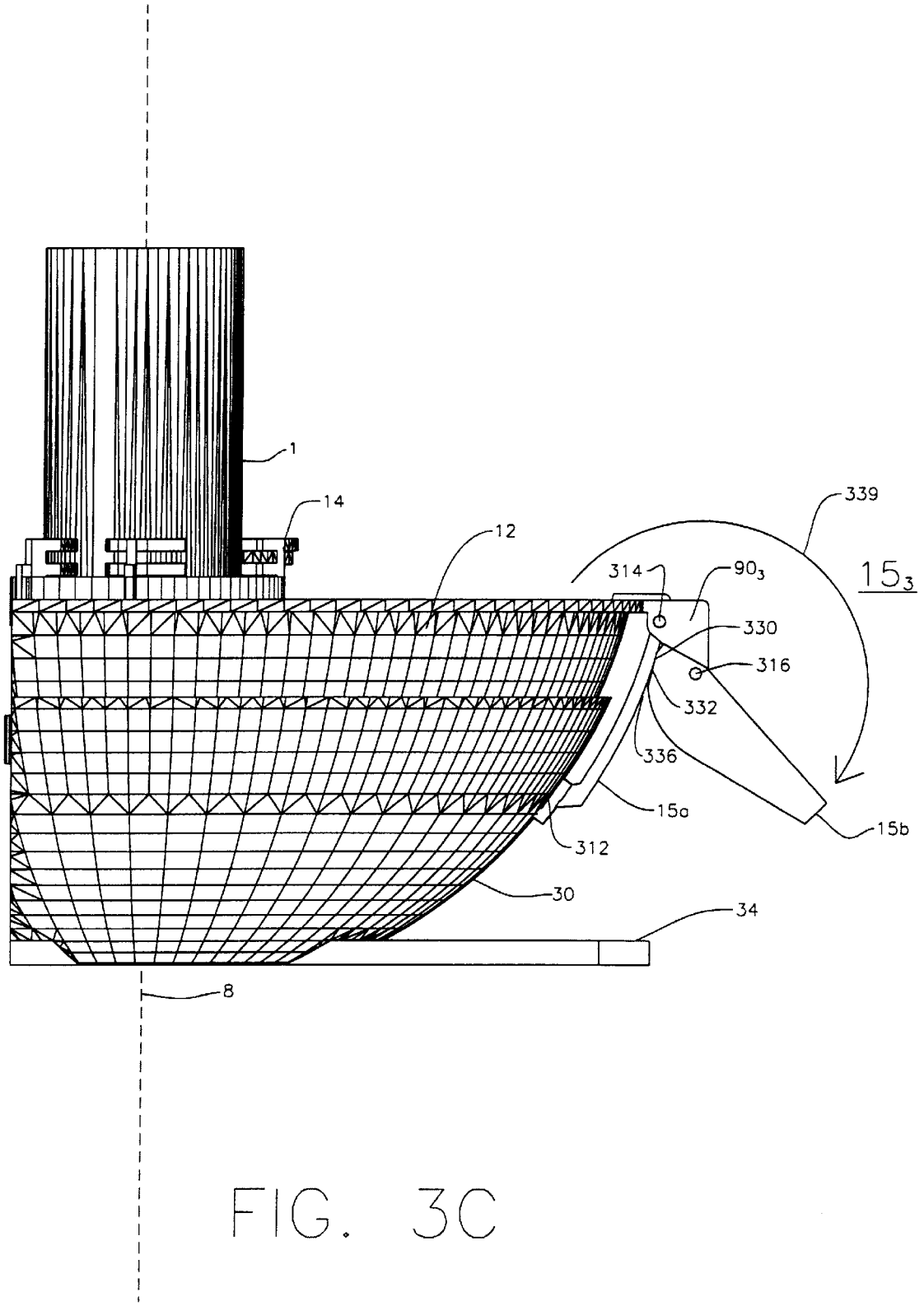
FIG. 3*c* is a side elevation of the assembled arrangement of FIG. 2 illustrating the bowl clamp of FIG. 3*a* in a second or clamped position.

FIG. 3*a* is an exploded view of a representative one of clamps $\mathbf{15}_1$, $\mathbf{15}_2$, and $\mathbf{15}_3$ of set 15 of clamps, taken to be clamp $\mathbf{15}_3$ for definiteness, and FIGS. 3*b* and 3*c* are side elevation views of the clamp of FIG. 3*a* in open and closed states, respectively. In FIGS. 3*a*, 3*b*, and 3*c*, clamp $\mathbf{15}_3$ includes an elongated bearing member 15*a* having a hinge portion 310 associated with its upper end 15*au* and a bearing portion or bearing pad 312 associated with its lower end 15*al*. Hinge portion 310 mates with a corresponding hinge portion 314 of clamp support member $\mathbf{90}_3$. As illustrated in FIG. 3*a*, hinge portion 310 of bearing member 15*a* is in the form of monolithic hinge pin sections 316 separated by a slot or channel, such that the hinge pin sections 316 can be squeezed together, and when released, will return to the illustrated state. Similarly, mating hinge section 314 of clamp support $\mathbf{90}_3$ is in the form of a pair of coaxial apertures (only one of which is visible in FIG. 3*a*) in clevis-shaped clamp support, with the apertures dimensioned to accommodate hinge pins 316. When hinge pins 316 lie within corresponding apertures 314, elongated bearing element 15*a* can swing between two states, namely the open state illustrated in FIG. 3*b*, and the closed or clamped state of FIG. 3*c*.

A spring arrangement, illustrated as a coil spring 320 in FIG. 3*a*, is associated with elongated bearing element 15*a*, and reacts against a portion of clamp support $\mathbf{90}_3$, for tending to urge the bearing element toward the open state of FIG. 3*b*. A combination of handle and cam member (cam) is illustrated as 15*b* in FIGS. 3*a*, 3*b*, and 3*c*. Cam member 15*b* is hingedly affixed to clamp support member $\mathbf{15}_3$, by a pair of hinge pins 328 integral with the clamp support member, and a corresponding set of apertures 326 (only one of which is visible in FIG. 3*a*), so that the cam member 15*b* can rotate about hinge pins 328. Cam member 15*b* also defines a cam nose 330, which is adapted to bear against a portion 336 of elongated bearing member 15*a* as cam member 15*b* is rotated about hinge pins 328. Portion 336 of elongated bearing member 15*a* lies in a central portion of bearing member 15*a* which is located between upper and lower end portions 15*au* and 15*al*, respectively, of the bearing member 15*a*, and rotation of cam 15*b* about hinge pins 328 in the direction indicated by arrow 339 of FIG. 3*b* tends to move cam nose 330 against center portion 336. This motion, in turn, tends to move bearing pad 312 toward the nested bowls, in a direction indicated by arrow 340 of FIG. 3*b*.

Further rotation of cam member 15*b* in the direction of arrow 339, as illustrated in FIG. 3*c*, causes cam nose portion 330 to come out of contact with elongated bearing member 15*a*, and brings over-center cam portion 332 into contact with center portion 336 of elongated bearing member 15*a*. The dimension between cam surface 332 and the axis of hinge pin 316 is selected so that an interference fit occurs, which tends to flex elongated bearing member 15*a* to cause a force to be applied by bearing pad 312 to the outer surface of outer bowl 30. This force tends to keep the inner and outer bowls in intimate contact, and to increase those forces which prevent movement of the bowls relative to each other.

A singular advantage of the clamping arrangement as illustrated in detail in FIGS. 3*a*, 3*b*, and 3*c* is that a person can operate the clamps by foot, while standing erect to view the tree's position or to hold the tree. Since the spring 320 tends to hold the clamp in the position illustrated in FIG. 3*b*, it is a simple matter to simply place the sole of the foot (or shoe) against the upper end of clamp member 15*b*, and draw the foot away from the tree, thereby rotating the clamp member into an approximately horizontal position, following which a force is exerted downward to close the clamp. This is performed in a more convenient body position than that required to manipulate the screws of the arrangement of the abovementioned application, yet retains its other advantages. Further, the clamp can be loosened by a simple upward flip of the handle end of the cam member, and it assumes a full-open condition as soon as it is loose, as a result of the force imparted by spring 320. The full-open position is distinct from the closed position of the clamp, and the state of the clamp is readily determined at a glance.

Figure 4A:
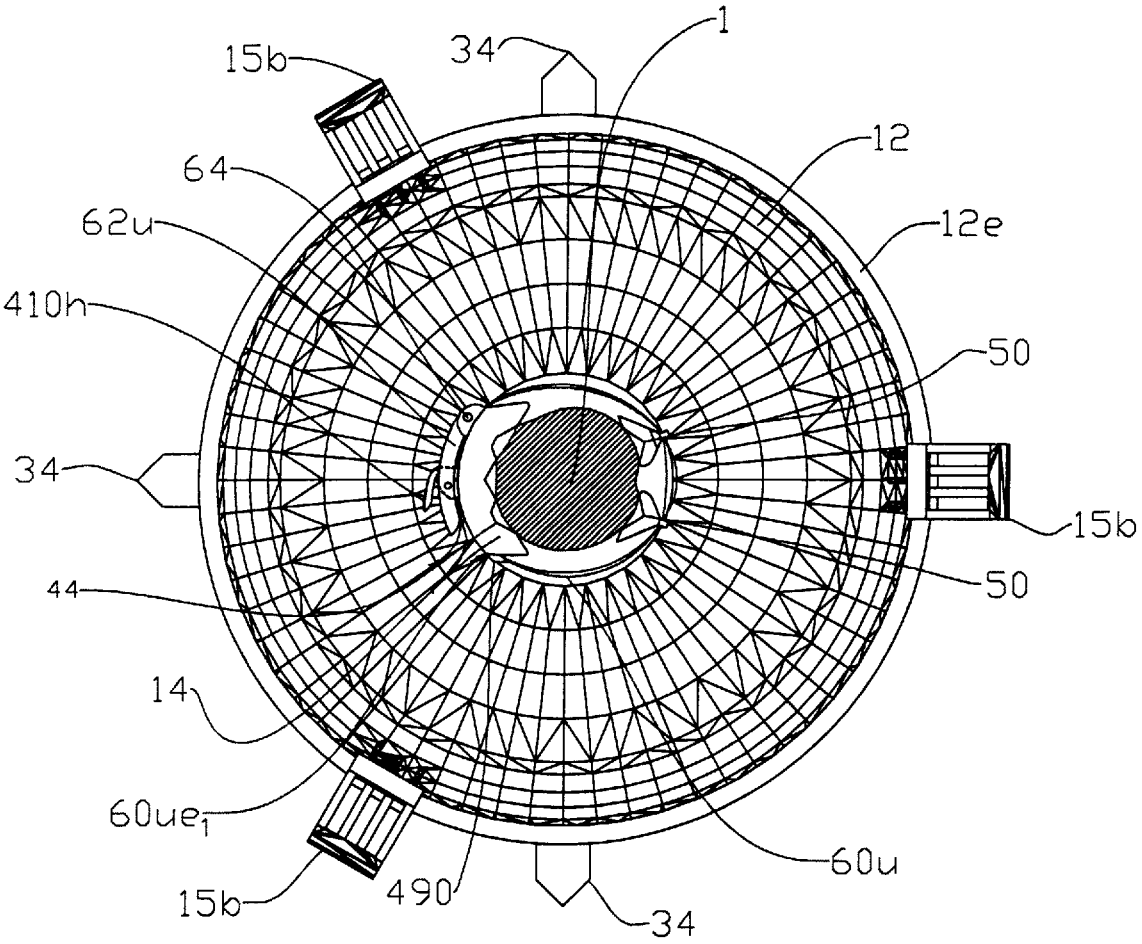
FIG. 4*a* is a cross-sectional view of the assembled stand and tree of FIGS. 2*a*, 2*b*, and 3*b*, looking in the direction of section lines 4*a*—4*a* of FIG. 3*b*.
Figure 4B:
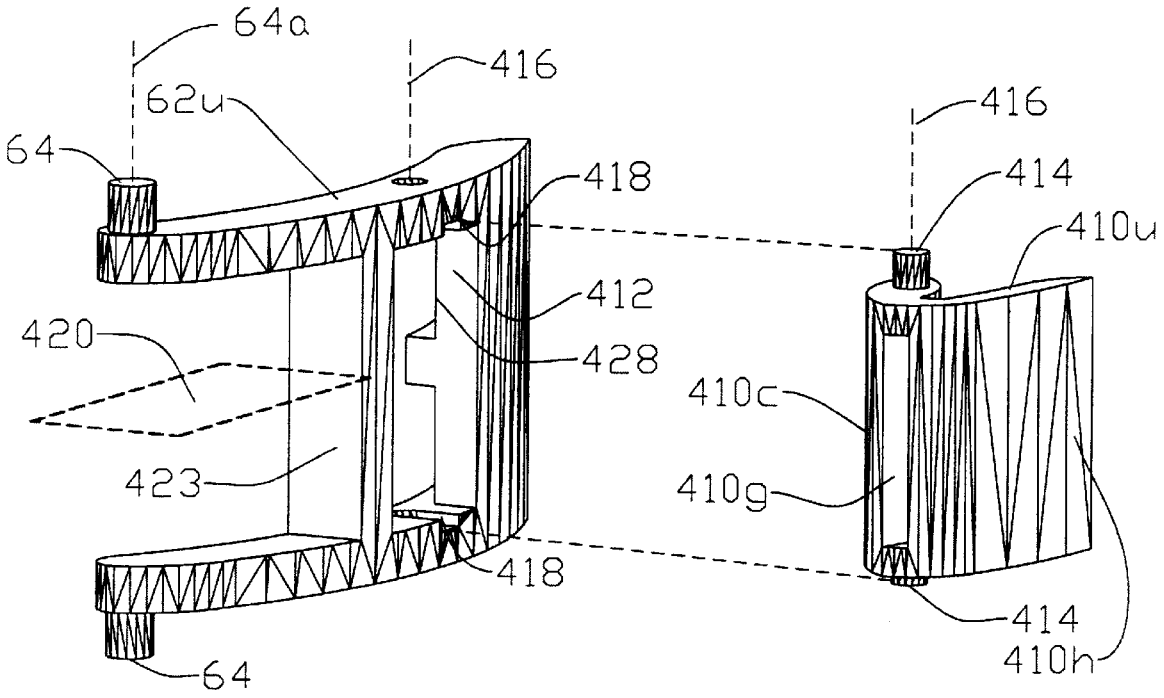
FIG. 4*b* is an exploded view of the strap clamp arrangement of the stand of FIGS. 1 and 2.
Figure 4C:
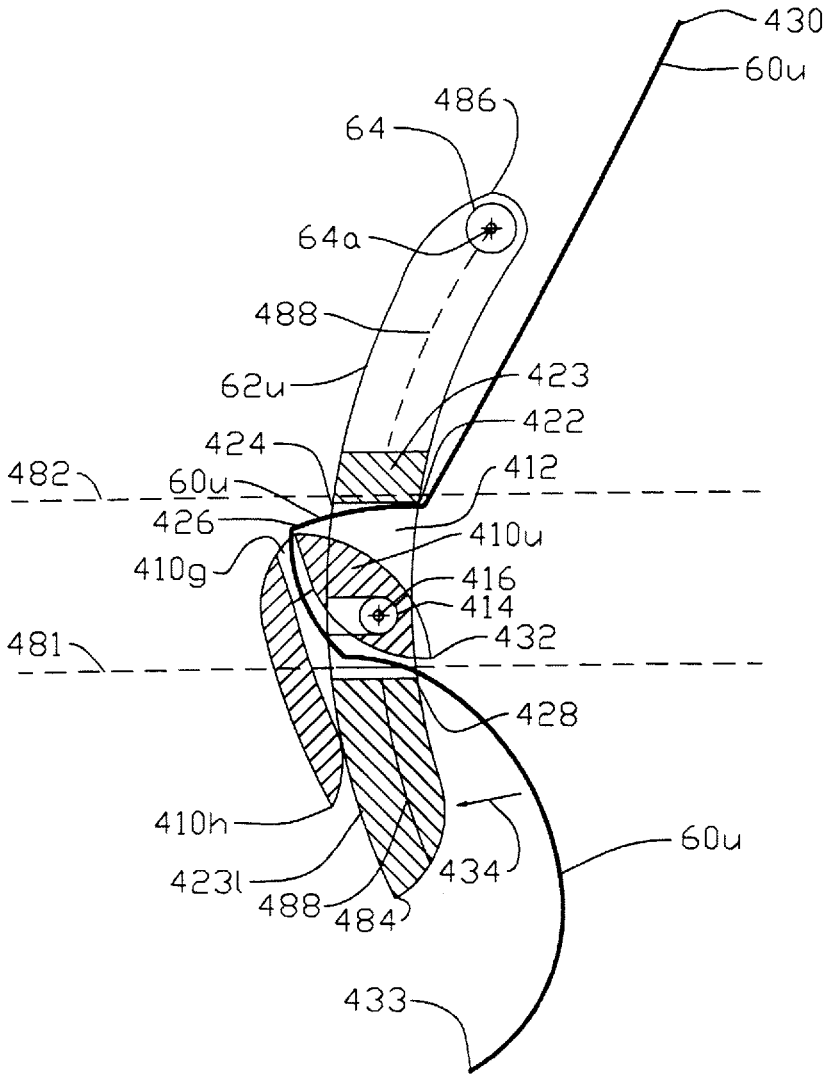
FIG. 4*c* is a simplified or skeletonized plan or overhead view which illustrates the strap clamp of FIG. 4*b* in a first or loose position which allows the strap length to be adjusted.

Referring again to FIGS. 1 and 2, upper and lower tree-trunk engaging straps 60*u* and 601, respectively, have their ends $\mathbf{60}ue_1$ and $\mathbf{601}e_1$, respectively, fixedly coupled to vertically-extending tree-trunk engaging vertical support portion 14. The straps 60*u* and 601 extend around the trunk 1, over, or preferably through portions of standoffs 50 at upper and lower positions, and return to a pair of over-center upper and lower clamp buckles 62*u* and 621, respectively. The clamp buckles 62*u* and 621 are associated with strap length adjusting clamps 410*u* and 4101, respectively. FIG. 4*a* is a cross-sectional view of the arrangement of FIGS. 1 and 2, taken looking in the direction of section lines 4*a*—4*a* of FIG. 3*b*. In FIG. 4*a*, the tree trunk 1 is engaged on one side by the serrated tree-engaging portion 44 of vertical support portion 14, and on the other side by a pair of standoffs 50. Strap 60*u* is affixed to vertical support portion 14 at a point 490, and strap 60*u* extends around the standoffs 50, between the vertical support structure 14 and hinge structure 64, and is affixed, as described below, to buckle 62*u*. When buckle 62*u* tensions belt 60*u*, the standoffs 50 pull the tree trunk 1 into intimate contact with serrated portion 44 of vertical support structure 14. FIG. 4*b* illustrates a representative clamp buckle, taken as being clamp buckle 62*u* for definiteness. In FIGS. 4*a*, 4*b*, and 4*c*, clamp buckle 62*u* has monolithic hinge pins 64, which coact with apertures associated with upper set of hinge portions 18*a* and 18*b* of FIGS. 1 and 2, so that the buckle can be rotated about an axis 64*a* associated with the hinge pins 64. As described in detail in the abovementioned Plzak patent application, the buckle is of an over-center type about hinge axis 64*a*, adapted for applying tension to the associated tree-engaging strap. The amount of actual travel of the clamp is relatively small as it is closed, because of its mechanical advantage. Consequently, the amount of strap extending about the tree from its fixed end to the clamp buckle should be such that very little motion toward the clamped or closed state is required by the clamp buckle in order to tension the strap. For this reason, the ability to firmly couple any point on the strap to the over-center clamp buckle is very desirable.

Figure 4D:
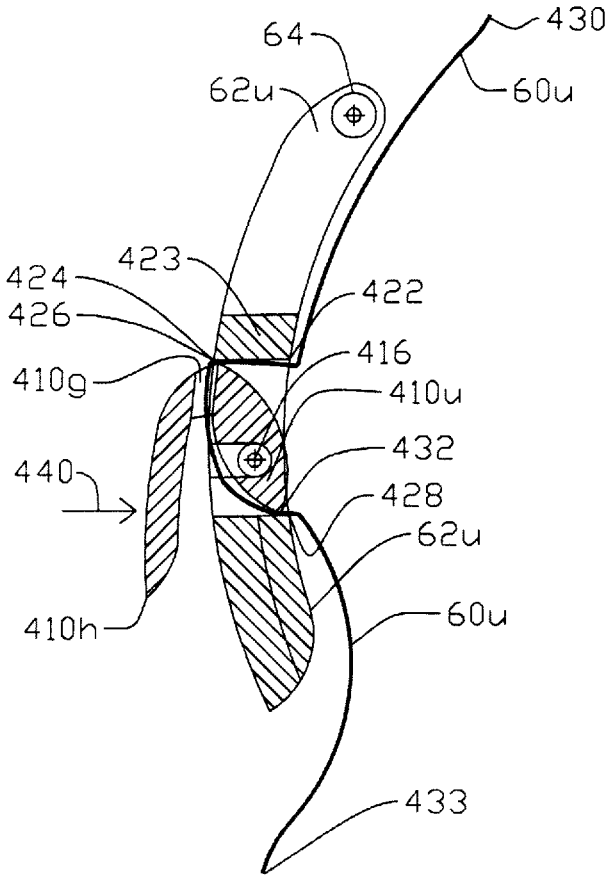
FIG. 4*d* is similar to FIG. 4*c* illustrating the strap clamp of FIG. 4*b* in second or clamped condition, which prevents the strap length from changing.

The arrangement of FIGS. 4*a*, 4*b*, 4*c*, and 4*d* illustrate clamp buckle 62*u* in conjunction with a strap-engaging cam 410*u*, which provides such a firm grip of the strap. The side of clamp buckle 62*u* which faces away from the tree trunk is illustrated in FIG. 4*b*. In FIGS. 4*a*, 4*b*, 4*c*, and 4*d*, clamp buckle 62*u* is illustrated as being somewhat curved, to fit a curved contour of an average-size tree trunk. Clamp buckle 62*u* may be considered to be bisected by a "horizontal" plane, part of which is illustrated as 420 in FIG. 4*b*, and FIGS. 4*c* and 4*d* illustrate the buckle 62*u* looking from plane 420. As illustrated in FIGS. 4*b*, 4*c*, and 4*d*, buckle 62*u* defines a through aperture 412, which is dimensioned to accommodate a cam member 410*u*. Cam member 410*u* includes a handle portion 410*h* and a cam portion 410*c*, rotatable about an axis 416 of monolithic hinge pins 414. Handle portion 410*h* is separated from cam portion 410*c* by a gap or strap slot 410*g*. Hinge pins 414 are dimensioned to fit within a pair of channels 418. Channels 418 have rounded ends which coact with hinge pins 414 to define a hinge arrangement which allows cam 410*u* to rotate about axis 416 relative to clamp buckle 62*u*.

FIGS. 4*d* and 4*c* represent the clamp buckle 62*u* of FIG. 4*b*, as seen in cross-section in plane 420, which is orthogonal to hinge axis 64*a* of FIG. 4*b*. Such a plane is partially illustrated in phantom as 420 of FIG. 4*b*. In the cross-sections of FIGS. 4*c* and 4*d*, the plane of the FIGURE is parallel to plane 420 of FIG. 4*b*. As illustrated in the cross-sections of FIGS. 4*c* and 4*d*, clamp buckle 62*u* is elongated, and has a clamp buckle hinge axis 64*a*, about which the clamp buckle can rotate as a whole relative to its underlying support structure, which is the vertical support 14, to provide over-center clamping of strap 60*u*. In the arrangement of FIGS. 4*c* and 4*d*, the end of strap 60*u* which extends around the tree trunk is illustrated as truncated at 430, and 433 is the free end of the strap. That portion of strap 60*u* lying between illustrated strap end 430 and clamp buckle 62*u* is illustrated as being straight, representing a tensile force. This force is applied to clamp buckle 62*u*, and is transferred through the clamp buckle to hinge pin arrangement 64, and then to the underlying support structure (not illustrated in FIGS. 4*a*, 4*b*, 4*c*, or 4*d*). In the position of strap 60*u* and clamp buckle 62*u* illustrated in FIG. 4*c*, the tension in the strap tends to create a moment which tends to rotate clamp buckle 62*u* counterclockwise (CCW) about axis 64*a*. This moment is resisted by contact between clamp buckle 62*u* and a part of the support structure (not illustrated in FIG. 4*c*) which applies a counterforce illustrated by an arrow 434, which prevents further CCW rotation of clamp buckle 62*u*. As a consequence of the illustrated locations of the strap 60*u*, hinge axis 64*a*, clamp buckle 62*u*, and force 434, tension in strap 60*u* on the end including strap end 430 tends to be transferred to the underlying support structure through the buckle hinge pin 64.

FIG. 4*c* represents the buckle with its cam in the open position. In the cross-section of FIG. 4*c*, cam portion 410*u* has approximately the shape of a lozenge. Strap 60*u* extends around a first structural edge 422 of a structure 423, through a portion of aperture 412, between a second structural edge 424 of structure 423 of buckle 62*u* and a first end 426 of cam 410*u*, over a surface of the cam 410*u* lying within strap slot 410*g*, and through a second space lying between a structural edge 428 of buckle 62*u* and a second end 482 of cam 410*u*. In the position of cam 410*u* which is illustrated in FIG. 4*c*, cam 410*u* is rotated about its hinges 414 to leave a space between structural edge 424 and cam end 426, and between structural edge 428 and cam end 432. Thus, strap 60*u* can be slipped through aperture 412, and through strap slot 410*g* and around cam 410*u* without binding, although those skilled in the art realize that the amount of effort required to slip the strap relative to the buckle and cam will depend upon the exact shape of the parts, on the coefficient of friction between the strap and the other parts, and possibly upon other considerations. In the position of the buckle illustrated in FIG. 4*c*, therefore, the length of the strap lying between free end 430 and the buckle may be adjusted at will to grip any size tree trunk.

FIG. 4*d* illustrates the buckle 62*u* with the cam 410*u* in the closed or clamped condition. As illustrated in FIG. 4*d*, cam 410*u* is rotated clockwise relative to its position in FIG. 4*c*, so that strap 60*u* is simultaneously pinched between (a) structural edge 424 and end 426 of cam 410*u* and (b) structural edge 428 and cam end 432. This simultaneous pinching between the cam ends and the structural edges tends to prevent the strap from slipping when tension is applied between end 430 and the buckle 62*u*. Also, any tension applied to end 430 tends to rotate cam 410*u* clockwise, further tending to increase the pinching forces between the two ends of the cam and structural edges 424, 428. Consequently, the cam grips the strap more tightly as tension is applied to the strap.

As also illustrated in FIGS. 4*c* and 4*d*, cam handle 410*h* is attached to cam 410*u* in a manner which allows a simple force applied to the handle 410*h* in the direction of arrow 440 to tend to rotate the cam counterclockwise, to thereby tend to release the pinching forces which hold the strap. Thus, a simple push on the cam handle 410*h* can release the strap, so long as the tension forces applied to end 430 are not too great. Those skilled in the art know that it may be necessary to release tension while pressing on the handle in order to fully release the strap.

Figure 4E:
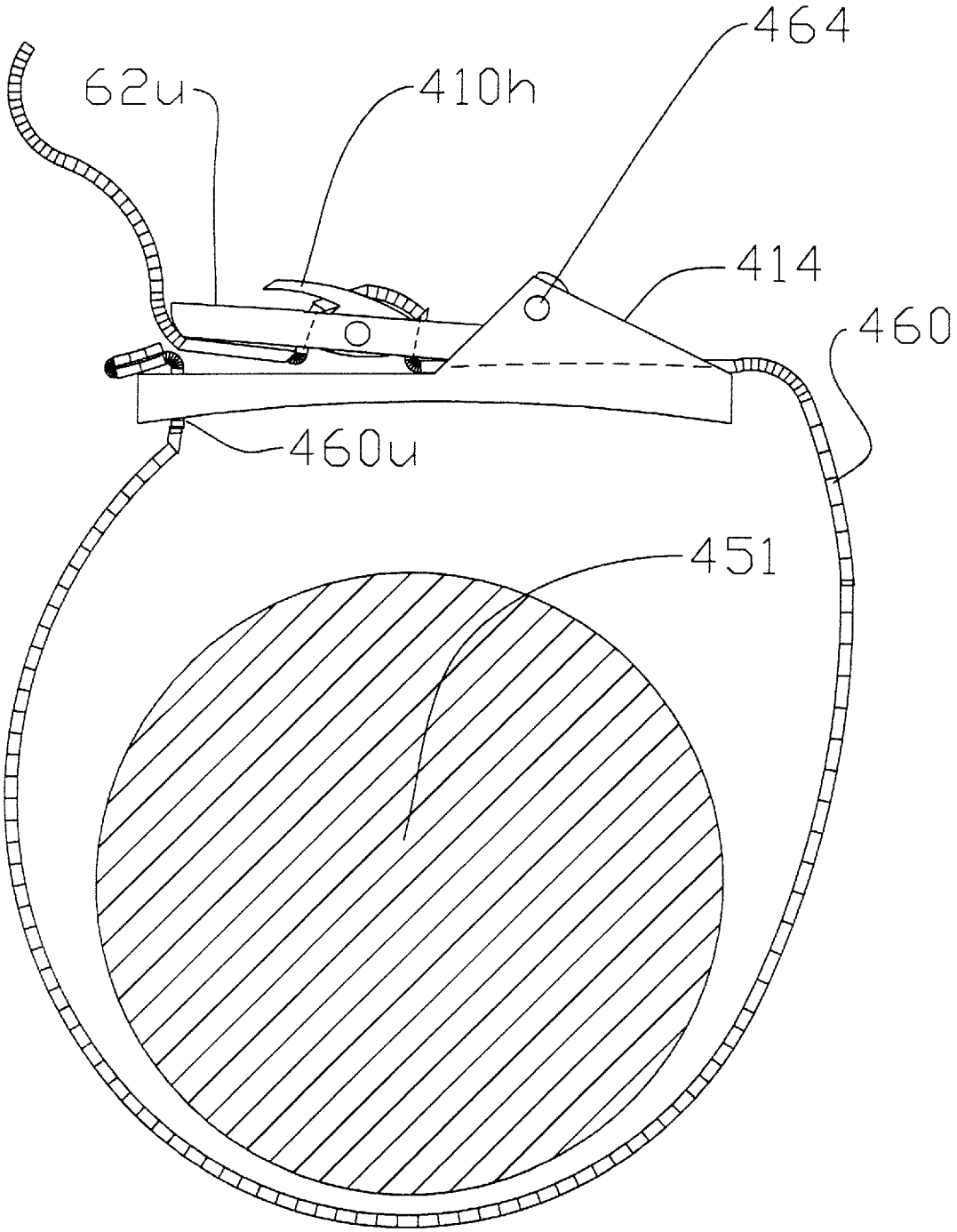
FIG. 4*e* illustrates a similar strap-buckle arrangement used as a belt.

FIG. 4*e* is similar to FIG. 4*a*, but illustrates a buckle and cam essentially the same as those of FIGS. 4*a*–4*d* used as a belt. In FIG. 4*e*, a body 451 has a belt strap 460 thereabout. One end of belt strap 460 is affixed to a buckle body 414 at a location 460*u*. The buckle body 414 has a hinge element 464 corresponding essentially to hinge element 64 of FIG. 4*a*, and a cam handle 410*h* corresponding to those of FIGS. 4*a*–4*d*. The details of the buckle 62*u* and cam 410 (not illustrated in detail in FIG. 4*e*) are identical to those of FIGS. 4*a*–4*d*.

Thus, the invention relates to a stand (10) for a decorative cut tree, which stand (10) includes an upward-facing inner bowl (12) which is approximately symmetric about an axis of symmetry (8). The inner bowl (12) includes a tree trunk support arrangement (14) adapted for supporting a tree trunk (1) in a position with the tree trunk (1) extending approximately parallel to the axis (8) of the inner bowl (12). The stand (10) also includes an upward-facing outer bowl-like member (30), dimensioned for accommodating at least a portion of the inner bowl (12) therein, in a manner which allows the inner bowl (12) to tilt relative to the outer bowl (30). The outer bowl (30) includes a base arrangement (34) adapted for allowing the outer bowl (30) to rest stably on a flat floor. A clamping arrangement (15*a*, 15*b*, 15*c*) is affixed to an upper portion of the inner bowl (12) for clamping the inner bowl (12) to the outer bowl (30). Each clamping arrangement ($15_1$, $15_2$, $15_3$) includes (a) an elongated first member (15*a*) hingedly affixed at its upper end (15*au*) to the inner bowl (12) by a first hinge arrangement (310) defining a first hinge axis (310*a*), and (*b*) a clamp member (15*b*) hingedly affixed to the inner bowl (12) by a second hinge axis (328*a*) extending parallel to the first hinge axis (310*a*). The elongated first member (15*a*) also includes a bearing portion (312) at its lower end (15*al*), which bearing portion (312) is adapted for bearing against the outer surface of the outer bowl (30) in one position of the elongated first member (FIG. 3*c*) about the first hinge axis (310*a*). Each clamp member ($15_1$, $15_2$, $15_3$) includes a handle portion (15*b*), and also includes a bearing portion (330) adapted for bearing against the elongated first member (15*a*) at a location (336) lying between the upper (15*au*) and lower (15*al*) ends of the first member, for providing a force tending to force the bearing end (312) of the elongated first member (15*a*) against the outer surface of the outer bowl (30), thereby urging the inner bowl (12) into intimate contact with the outer bowl (30) at the location of the bearing portion (312)

of the elongated first member (15*a*). A stand (10) according to a particular embodiment of the invention includes an over-center bearing portion (332) of the clamp member (15*b*) which, in a closed condition of the clamping arrangement ($\mathbf{15}_1$, $\mathbf{15}_2$, $\mathbf{15}_3$), tends to maintain the clamping arrangement in the closed condition (FIG. 3*c*). In an embodiment of the invention (FIG. 3*a*), at least one of the first (310, 314) and second (326, 328) hinges are formed, in part, by a clevis ($\mathbf{90}_3$) affixed to an upper portion (12*e*) of the inner bowl (12). The clevis ($\mathbf{90}_3$) includes first (901) and second (90*r*) forks, and defines apertures (314) at the locations of at least one of the first (310, 314) and second (326, 328) hinge axes. A stand (10) according to an embodiment of the invention (FIG. 3*a*) has the hinge-defining portion (314) of the clevis ($\mathbf{90}_3$) at the locations of the first hinge axis (310*a*) lying closer to the axis of revolution (8) of the inner bowl (12) than the hinge-defining portion (328) of the clevis ($\mathbf{90}_3$) at the locations of the second hinge axis (328*a*). Each stand (10) according to the invention preferably includes a plurality of the clamping members ($\mathbf{15}_1$, $\mathbf{15}_2$, $\mathbf{15}_3$) spaced about the periphery of the inner bowl (12), and the plurality is preferably three.

A buckle (62*u*) according to another aspect of the invention imparts a tensile force between an elongated flexible strap (60*u*) and a buckle hinge (64, 64*a*) or support arrangement (14, 414). The buckle (62*u*) comprises a main buckle structure (62*u*) adapted to be coupled by the buckle hinge (64) or support arrangement (64, 414) for transferring force from the main buckle (62*u*) structure in a direction normal to the axis (64*a*) of the buckle hinge or support arrangement. The main buckle structure is elongated along a curved "axis" of elongation (488) as seen in a plane (420) which is orthogonal to the axis (64*a*) of the buckle hinge (64) or support arrangement (64, 614), and defines first (486) and second (484) ends as seen in that plane (420). The buckle hinge (64) or support arrangement is coupled to the first end (486) of the main buckle structure for rotation about the axis of the buckle hinge (64) or support arrangement. The main buckle structure (62*u*) further defines first (422) and second (424) load bearing portions or edges of a buckle structure (423), each of which extends parallel with the axis (64*a*) of the buckle hinge (64) or support arrangement at fixed locations on the main buckle (64*u*) structure, which fixed locations lie between the first (486) and second (484) ends of the main buckle structure. Both the elongated first (422) and second (424) load bearing portions lie in a second plane (482). The second plane (482) is generally transverse to the "axis" of elongation (488) of the main buckle (62*u*) structure. The main buckle (62*u*) structure further defines an elongated third load bearing portion or edge (428) extending parallel with the axis (64*a*) of the buckle hinge or support arrangement, and lying in a third plane (481) which is generally transverse to the "axis" (488) of elongation of the buckle (62*u*) structure (as seen in plane 420). The third plane (481) lies parallel with the second plane (482) at a location lying between the second plane (482) and the second end (484) of the main buckle (62*u*) structure. The main buckle (62*u*) structure further includes a second hinge coupler (418) defining a second hinge axis (416) parallel with the axis (64*a*) of the buckle hinge or support arrangement (64). The second hinge axis (416) lies between the second plane (482) and the third plane (481). A cam arrangement (410*u*) defines a first load bearing portion (426) near a first end thereof and a second load bearing portion (432) near a second end thereof. The cam arrangement includes a second hinge coupler (414) lying between the first (426) and second (432) ends of the cam arrangement (410*u*). The second hinge coupler (414) is adapted for hinged coupling of the cam (410*u*) to the second hinge coupler (418) of the main buckle (62*u*) structure, for rotation of the cam (410*u*) relative to the main buckle (62*u*) structure between a closed position (FIG. 4*d*) and an open (FIG. 4*c*) position. The closed position (FIG. 4*d*) is one in which the first load bearing portion (426) of the cam arrangement (410*u*) is juxtaposed with the first load bearing portion (424) of the main buckle (62*u*) structure, and the second load bearing portion (432) of the cam arrangement (410*u*) is juxtaposed with the third load bearing portion (428) of the main buckle (62*u*) structure, and the open position (FIG. 4*c*) of the cam arrangement (410*u*) relative to the main buckle (62*u*) structure is one in which the cam arrangement is rotated so that the first bearing portion (426) of the cam arrangement (410*u*) is separated from the first bearing portion (424) of the main buckle (62*u*) structure by an amount greater than in the closed position (FIG. 4*d*), and in which the second bearing portion (432) of the cam arrangement (410*u*) is separated from the third bearing portion (428) of the main buckle (62*u*) structure by an amount greater than in the closed position. As a result of this dimensioning, a strap (60*u*) extending, in order, past the buckle hinge (64) or support arrangement, partially around the second load bearing portion (422) of the main buckle (62*u*) structure, between the first bearing portion (426) of the cam arrangement (410*u*) and the second bearing portion (424) of the main buckle (62*u*) structure, and between the second bearing portion (432) of the cam arrangement (410*u*) and the third bearing portion (428) of the main buckle (62*u*) structure, is simultaneously pinched between (a) the first bearing portion (426) of the cam arrangement (410*u*) and the second bearing portion (424) of the main buckle (62*u*) structure, and (b) the second bearing portion (432) of the cam arrangement (410*u*) and the third bearing portion (428) of the main buckle (62*u*) structure, in the closed position (FIG. 4*d*) of the cam arrangement (410*u*), in a manner such that tensile forces applied to the strap (60*u*) relative to the buckle tend to increase the pinch, thereby tending to grip the strap more firmly with increasing tensile forces. Also, in the open position of the cam arrangement, the strap is substantially free to slip, without being pinched, past (a) the first bearing portion (426) of the cam arrangement (410*u*) and the second bearing portion (424) of the main buckle (62*u*) structure, and (b) the second bearing portion (432) of the cam arrangement (410*u*) and the third bearing portion (428) of the main buckle structure.

Other embodiments of the invention will be apparent to those skilled in the art. For example, while three clamps have been illustrated for clamping the inner and outer bowls together, more or fewer clamps may be used. The spacing of the clamps 15 about the periphery of the bowl has been illustrated as at equal 120° angles about axis 8, but the spacing may be at unequal angles, if desired. The clamps have been illustrated as being affixed to the inner bowl, but they could be affixed to the outer bowl, and bear against the inner bowl. While hinge portion 310 of bearing member 15*a* is in the form of monolithic hinge pin sections 316 as illustrated in FIGS. 3*a*, 3*b*, and 3*c*, and mating hinge section 314 of clamp support $\mathbf{90}_3$ is in the form of mating coaxial apertures, those skilled in the art know that each half of the hinge could include mating coaxial apertures, and that a separate hinge pin could extend through all the apertures in such a case, or that the clamp support member could bear the integral or monolithic hinge pins, and the upper end of the bearing member could have the mating apertures. As a further alternative, the upper end of the bearing member could have one monolithic hinge pin and one coaxial aperture, and the associated clamp support member could also have one monolithic hinge pin and one coaxial aperture, which mate together to form a complete hinge. Such alternative arrangements of hinge elements are well known to those skilled in the art.

What is claimed is:

1. A buckle for imparting a tensile force between an elongated flexible strap and a buckle hinge pin means, said buckle comprising:

a main buckle member adapted to be coupled by said buckle hinge pin means for transferring force from said main buckle member in a direction normal to an axis of said buckle hinge pin means, said main buckle member being elongated along an axis of elongation from a plane orthogonal to said axis of said buckle hinge pin means, and defining first and second ends therein, said buckle hinge pin means being coupled to said first end of said main buckle member for rotation about said axis of said buckle hinge pin means, said main buckle member further defining elongated first and second load bearing portions, each of said elongated first and second load bearing portions extending parallel with said axis of said buckle hinge pin means fixed locations on said main buckle member lying between said first and second ends of said main buckle member, both said elongated first and second load bearing portions lying in a second plane generally transverse to said axis of elongation of said main buckle member, said main buckle member further defining an elongated third load bearing portion extending parallel with said axis of said buckle hinge pin means, and lying in a third plane which is generally transverse to said axis of elongation, said third plane being at a location lying between said second plane and said second end of said main buckle member, said main buckle member further including second hinge coupling means defining a second hinge axis parallel with said axis of said buckle hinge pin means, said second hinge axis lying between said second plane and said third plane;

a cam member defining a first load bearing portion near a first end thereof and a second load bearing portion near a second end thereof, said cam member including second hinge coupling means lying between said first and second ends of said cam member, said second hinge coupling means being adapted for hinged coupling of said cam means to said second hinge coupling means of said main buckle member, for rotation of said cam member relative to said main buckle member between a closed position and an open position, whereby in said closed position said first load bearing portion of said cam member is juxtaposed with said second load bearing portion of said main buckle member and said second load bearing portion of said cam member is juxtaposed with said third load bearing portion of said main buckle member, and whereby in said open position of said cam member relative to said main buckle member said cam member is rotated so that said first bearing portion of said cam member is separated from said second bearing portion of said main buckle member by an amount greater than in said closed position, and in which said second bearing portion of said cam member is separated from said third bearing portion of said main buckle member by an amount greater than in said closed position, whereby a strap is adapted to extend past said buckle hinge pin means, partially around said second load bearing portion of said main buckle member, between said first bearing portion of said cam means and said second bearing portion of said main buckle member, and between said second bearing portion of said cam member and said third bearing portion of said main buckle member, is simultaneously pinched between said first bearing portion of said cam means and said second bearing portion of said main buckle member, and said second bearing portion of said cam member and said third bearing portion of said main buckle member, in said closed position of said cam member, in a manner such that tensile forces applied to said strap relative to said buckle tend to increase said pinch, thereby tending to grip said strap more firmly with increasing tensile forces, and whereby, in said open position of said cam member, said strap is substantially free to slip without being pinched past said first bearing portion of said cam means and said second bearing portion of said main buckle member, and said second bearing portion of said cam member and said third bearing portion of said main buckle member.

2. A buckle for tightening a strap, said buckle comprising:

a main support;

a buckle structure hinged to said main support at a hinge, said buckle structure including a handle and a cam hinge arrangement and a cam means adapted to couple the strap to said buckle structure at a location between said hinge and said handle, wherein said cam means includes first and second load-bearing portions respectively at first and second ends, said cam means being coupled at a location lying between said first and second ends by said cam hinge arrangement to said buckle structure for movement about said cam hinge arrangement between closed and open conditions of said cam means, said load-bearing portions of said cam means at said first and second ends being in said closed condition, pressed against corresponding first and second load-bearing portions of said buckle structure, with said strap adapted to be pinched therebetween at said load-bearing portions at said first and second ends for thereby tending to hold said strap fixedly against said buckle structure, and said load-bearing portions of said cam means at said first and second ends in said open condition, spaced away from said corresponding first and second load-bearing portions of said buckle structure, respectively, thereby allowing said strap to be adapted to slip relative to said buckle structure.

3. A device for tightening a strap comprising:

i) a buckle structure comprising a cam hinge arrangement and a cam means, adapted to couple a strap to the buckle structure having first and second load-bearing portions at first and second ends of the cam means, the cam means being coupled at a location between the first and second ends to the buckle structure by the cam hinge arrangement for movement about the cam hinge arrangement between closed and open conditions of said cam means, the first and second load bearing portions of the cam means respectively at the first and second ends being in the closed position, pressed against corresponding said first and second load bearing portions of the buckle structure so that a strap is adapted to be pinched therebetween at the location of the load bearing portions of the cam means at the first and second ends, thereby tending to hold the strap fixedly against the buckle structure, and the load bearing portions of the cam means at the first and second ends being, in the open condition, spaced away from the corresponding first and second load bearing portions of the buckle structure, respectively, thereby allowing the strap to be adapted to slip relative to the buckle structure, and ii) a hinge means for over center-clamping, wherein the buckle structure is coupled to the hinge means for over-center clamping.

* * * * *